US005782149A

United States Patent [19]

Jensen

[11] Patent Number: 5,782,149

[45] Date of Patent: Jul. 21, 1998

[54] ELECTROMAGNETIC SCREWDRIVER

[76] Inventor: Phillip D. Jensen, 13926 W. Warren Dr., Lakewood, Colo. 80228

[21] Appl. No.: 728,141

[22] Filed: Oct. 9, 1996

[51] Int. Cl.[6] ..... B25B 13/06

[52] U.S. Cl. ..... 81/125; 294/65.5; 81/900

[58] Field of Search ..... 81/451, 900, 439, 81/125; 294/65.5; 279/128

[56] References Cited

U.S. PATENT DOCUMENTS

| | | | |
|---|---|---|---|
| 3,924,115 | 12/1975 | Hampton et al. | 294/65.5 X |
| 4,017,386 | 4/1977 | Barry | 294/65.5 X |
| 5,261,714 | 11/1993 | Slusar et al. | 294/65.5 |

FOREIGN PATENT DOCUMENTS

| | | | |
|---|---|---|---|
| 3345333 | 6/1985 | Germany | 81/125 |

*Primary Examiner*—D. S. Meislin

[57] ABSTRACT

A new Electromagnetic Screwdriver for offering an electromagnet in combination with a manual driven or an electrically driven screwdriver. The inventive device includes electrical windings, a handle, a drive shaft, and a switch. In use, the Electromagnetic Screwdriver 10 is equipped with a tool fitting of choice and allows momentary magnetic attraction while maneuvering to install or unassemble a screw or the like and prevents uncontrollable harmful effects of a magnetic contact with magnetic sensitive components. The magnetic coils can be included in the shaft of the screwdriver, ratchet, or other tool, extended to energize magnetic coils in a variety of extensions for the screwdriver, ratchet, or other tool, or included in a tool tip of the screwdriver, ratchet, or other tool.

5 Claims, 5 Drawing Sheets

FIG. 3A
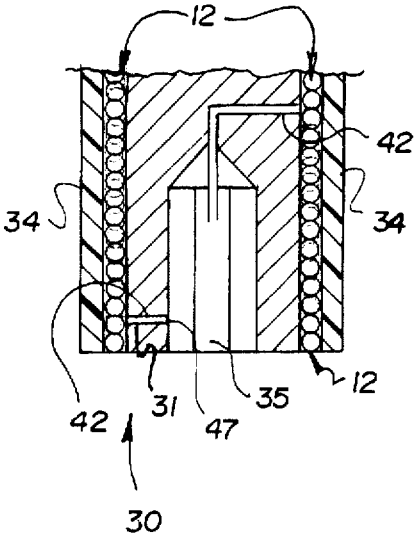
FIG. 3
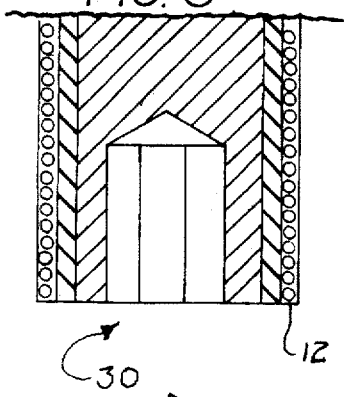
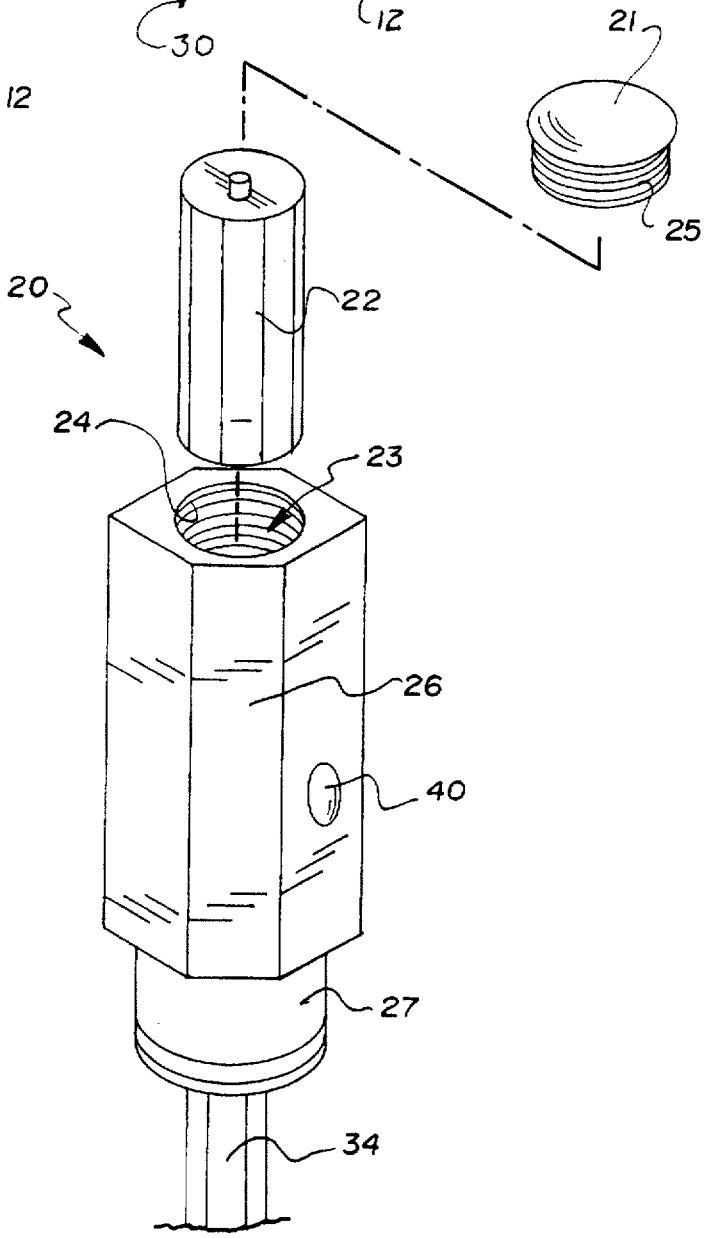
FIG. 4

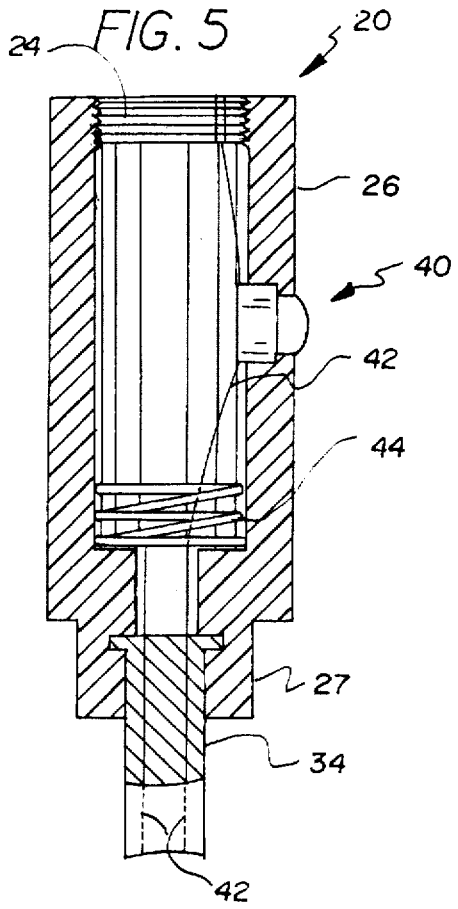
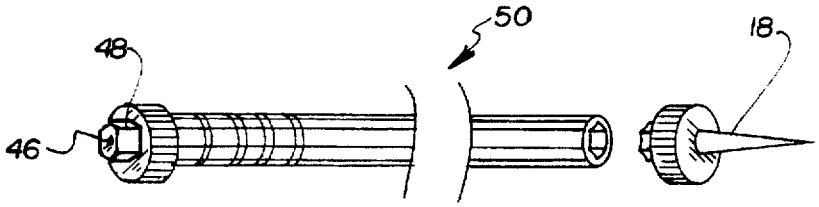
FIG. 6

ELECTROMAGNETIC SCREWDRIVER

BACKGROUND OF THE INVENTION

1. Field of the Invention

The present invention relates to magnetic screw drivers and more particularly pertains to a new Electromagnetic Screwdriver for offering an electromagnet in combination with a manual driven or an electrically driven screwdriver.

2. Description of the Prior Art

The use of magnetic screw drivers is known in the prior art. More specifically, magnetic screw drivers heretofore devised and utilized are known to consist basically of familiar, expected and obvious structural configurations, notwithstanding the myriad of designs encompassed by the crowded prior art which have been developed for the fulfillment of countless objectives and requirements.

Known prior art magnetic screw drivers include U.S. Pat. No. 3,884,282; U.S. Pat. No. 5,261,714; U.S. Pat. Des. 340,634; U.S. Pat. No. 4,827,812; U.S. Pat. No. 4,916,988; and U.S. Pat. No. 4,724,382.

While these devices fulfill their respective, particular objectives and requirements, the aforementioned patents do not disclose a new Electromagnetic Screwdriver. The inventive device includes electrical windings, a handle, a drive shaft, and a switch.

In these respects, the Electromagnetic Screwdriver according to the present invention substantially departs from the conventional concepts and designs of the prior art, and in so doing provides an apparatus primarily developed for the purpose of offering an electromagnet in combination with a manual driven or an electrically driven screwdriver.

SUMMARY OF THE INVENTION

In view of the foregoing disadvantages inherent in the known types of magnetic screw drivers now present in the prior art, the present invention provides a new Electromagnetic Screwdriver construction wherein the same can be utilized for offering an electromagnet in combination with a manual driven or an electrically driven screwdriver.

The general purpose of the present invention, which will be described subsequently in greater detail, is to provide a new Electromagnetic Screwdriver apparatus and method which has many of the advantages of the magnetic screw drivers mentioned heretofore and many novel features that result in a new Electromagnetic Screwdriver which is not anticipated, rendered obvious, suggested, or even implied by any of the prior art magnetic screw drivers, either alone or in any combination thereof.

To attain this, the present invention generally comprises electrical windings, a handle, a drive shaft, and a switch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Electromagnetic Screwdriver apparatus and method which has many of the advantages of the magnetic screw drivers mentioned heretofore and many novel features that result in a new Electromagnetic Screwdriver which is not anticipated, rendered obvious, suggested, or even implied by any of the prior art magnetic screw drivers, either alone or in any combination thereof.

It is another object of the present invention to provide a new Electromagnetic Screwdriver which may be easily and efficiently manufactured and marketed.

It is a further object of the present invention to provide a new Electromagnetic Screwdriver which is of a durable and reliable construction.

An even further object of the present invention is to provide a new Electromagnetic Screwdriver which is susceptible of a low cost of manufacture with regard to both materials and labor, and which accordingly is then susceptible of low prices of sale to the consuming public, thereby making such Electromagnetic Screwdriver economically available to the buying public.

Still yet another object of the present invention is to provide a new Electromagnetic Screwdriver which provides in the apparatuses and methods of the prior art some of the advantages thereof while simultaneously overcoming some of the disadvantages normally associated therewith.

Still another object of the present invention is to provide a new Electromagnetic Screwdriver for offering an electromagnet in combination with a manual driven or an electrically driven screwdriver.

Yet another object of the present invention is to provide a new Electromagnetic Screwdriver which includes electrical windings, a handle, a drive shaft, and a switch.

Still yet another object of the present invention is to provide a new Electromagnetic Screwdriver that allows momentary magnetic attraction while maneuvering to install or unassemble a screw or the like.

Even still another object of the present invention is to provide a new Electromagnetic Screwdriver that prevents uncontrollable harmful effects of a magnetic contact with magnetic sensitive components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is an exploded isometric illustration of the present invention.

FIG. 5 is a cross sectional view taken along line 5—5 of FIG. 1.

FIG. 6 is a perspective view of a flexible shaft extension of the present invention.

DESCRIPTION OF THE PREFERRED EMBODIMENT

Figure 1:
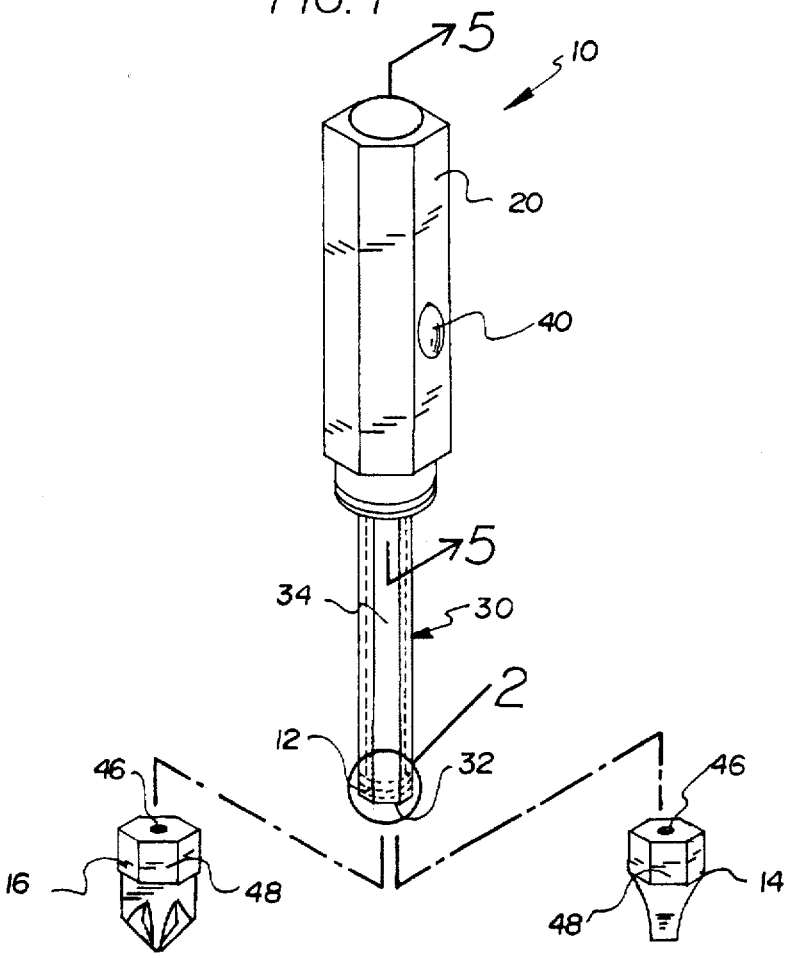
FIG. 1 is a right sidle perspective view of a new Electromagnetic Screwdriver according to the present invention.
Figure 2:
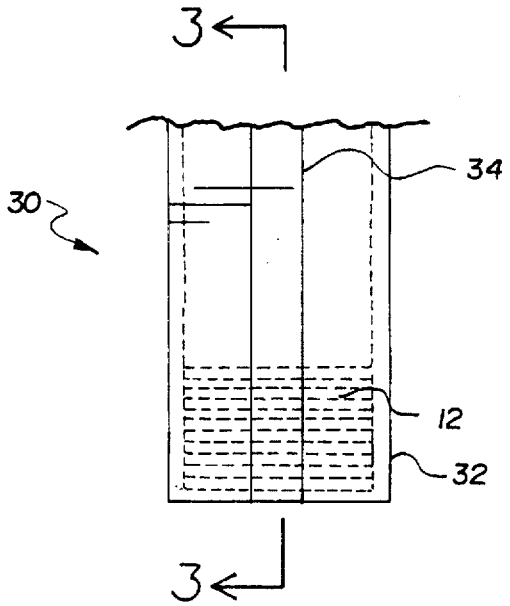
FIG. 2 is an enlarged side elevation view of a lower end of a drive shaft of the present invention.

With reference now to the drawings, and in particular to FIGS. 1 through 6 thereof, a new Electromagnetic Screwdriver embodying the principles and concepts of the present invention and generally designated by the reference numeral 10 will be described.

More specifically, it will be noted that the Electromagnetic Screwdriver 10 comprises electrical windings 12, a handle 20, a drive shaft 30, and a switch 40 where the handle 20 and the drive shaft 30 are joined together and the handle 20 includes the switch 40 and the drive shaft 30 includes the electrical windings 12.

As best illustrated in FIGS. 1 through 6, it can be shown that the handle 20 is comprised of a handle grip 26, a handle drive tube 27, a battery 22, a battery aperture 23, and a battery cap 21 where the handle 20 is an elongated cylindrical shape and the handle grip 26 defines the upper outer periphery of the handle 20 and the handle drive tube 27 is an inner portion of the handle 20 and extendingly protrudes out of a lower end of the handle 20 and where the handle drive tube 27 at an upper end integrally forms the battery aperture 23 where the battery aperture 23 matingly receives the battery 22 and the battery 22 is removably retained by the battery cap 21 which is removably attached to the handle 20.

The battery aperture 23 further includes an aperture attachment means 24 and the battery cap 21 further includes a cap attachment means 25 where the aperture attachment means 24 matingly receives the cap attachment means 25. The aperture attachment means 24 and the cap attachment means 25 are further defined as screw threads which are sized to matingly engage one another.

The drive shaft 30 is comprised of a torsion shaft 31, a tool end 32, a stem 34, and a tool aperture 35 where, referring to FIG. 3, the torsion shaft 31 is an inner material preferably made of metal, where the tool end 32 is the distal end of the torsion shaft 31 and where the torsion shaft 31 concentrically includes the tool aperture 35 which protrudes up into the inner material and the stem 34 is defined as an outer cover of the torsion shaft 31 and where the torsion shaft 31 is wrapped with the electrical windings 12 and the torsion shaft 31 together with the electrical windings 12 are matingly received within the stem 34.

The switch 40 is movably attached to the handle 20 and is electrically connected to electric circuit wires 42 and where the handle 20 further includes a battery spring 44 which is spring biasedly disposed between the battery 22 and an upper end of the handle drive tube 27.

Referring to FIGS. 1 and 3, a flat head tool 14 is sizingly shaped to enable it to matingly fit into the tool aperture 35 of the drive shaft 30 and is in torsional engagement with the drive shaft 30 and includes a positive receptacle 46 and a negative receptacle 48 and where the tool end 32 further includes a positive pin pole 45 and a negative contact 47 which are fixedly attached to the torsion shaft 31 and are in electrical connection with the electrical windings 12 which are wrapped around the torsion shaft 31 and when the flat head tool 14 is insertedly in torsional engagement with the tool aperture 35 and therefore the drive shaft 30, the positive receptacle 46 and the negative receptacle 48 are therefore in matingly electrical connection with the positive pin pole 45 and the negative contact 47.

Again, referring to FIG. 1, a cross point tool 16 is sizingly shaped to enable it to matingly fit into the tool aperture 35 of the drive shaft 30 and is in torsional engagement with the drive shaft 30 and includes the positive receptacle 46 and the negative receptacle 48 and where the tool end 32 further includes the positive pin pole 45 and the negative contact 47 which are fixedly attached to the torsion shaft 31 and are in electrical connection with the electrical windings 12 which are wrapped around the torsion shaft 31 and when the cross point tool 16 is insertedly in torsional engagement with the tool aperture 35 and therefore the drive shaft 30, the positive receptacle 46 and the negative receptacle 48 are therefore in matingly electrical connection with the positive pin pole 45 and the negative contact 47.

Furthermore, referring to FIG. 6, a needle point tool 18 can also be useful in retrieving ferrous parts and is likewise sizingly shaped to enable it to matingly fit into the tool aperture 35 of the drive shaft 30 and is in torsional engagement with the drive shaft 30 and includes the positive receptacle 46 and the negative receptacle 48 and where the tool end 32 further includes the positive pill pole 45 and the negative contact 47 which are fixedly attached to the torsion shaft 31 and are in electrical connection with the electrical windings 12 which are wrapped around the torsion shaft 31 and when the needle point tool 18 is insertedly in torsional engagement with the tool aperture 35 and therefore the drive shaft 30, the positive receptacle 46 and the negative receptacle 48 are therefore in matingly electrical connection with the positive pin pole 45 and the negative contact 47.

Additionally, referring to FIG. 6, a flexible shaft extension 50 can be inserted between the tool aperture 35 of the drive shaft 30 and is in torsional engagement with the drive shaft 30 and includes the positive receptacle 46 and the negative receptacle 48 and where the tool end 32 further includes the positive pill pole 45 and the negative contact 47 which are fixedly attached to the torsion shaft 31 and are in electrical connection with the electrical windings 12 which are wrapped around the torsion shaft 31 and when the flexible shaft extension 50 is insertedly in torsional engagement with the tool aperture 35 and therefore the drive shaft 30, the positive receptacle 46 and the negative receptacle 48 are therefore in matingly electrical connection with the positive pin pole 45 and the negative contact 47 and therefore extend out to a distal receptacle tool end which in similar manner can receive any one of the flat head tool 14 or the cross point tool 16, and so forth.

Figure 7:
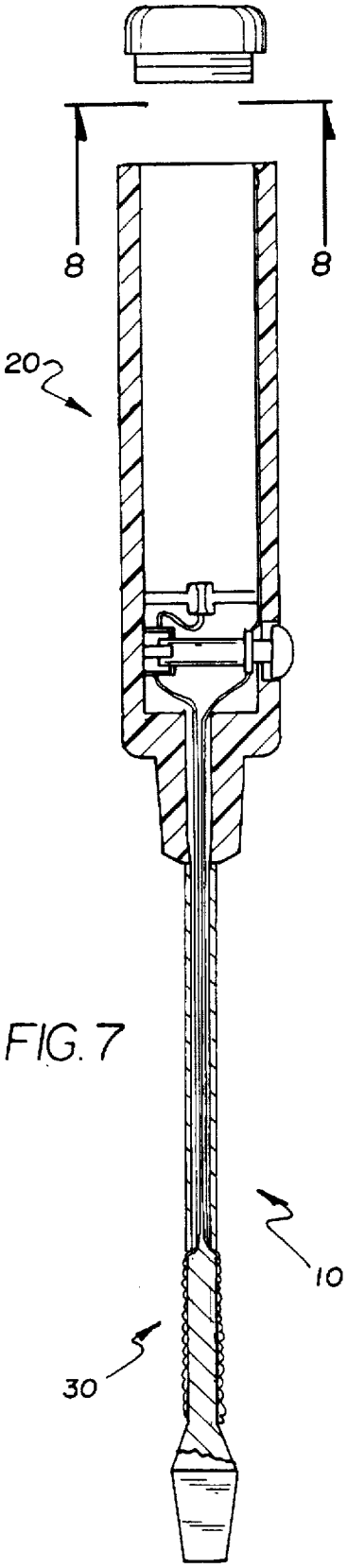
FIG. 7 is a cross sectional view of another embodiment of the present invention showing electromagnetic coils wrapped around an outer perimeter in close proximity adjacent to a tool tip in a unitary screwdriver construction.
Figure 8:
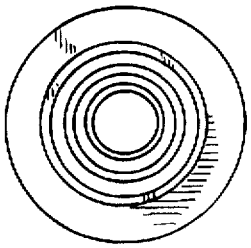
FIG. 8 is a bottom view taken along line 8—8 of FIG. 7 showing a battery cap of the present invention.
Figure 9:
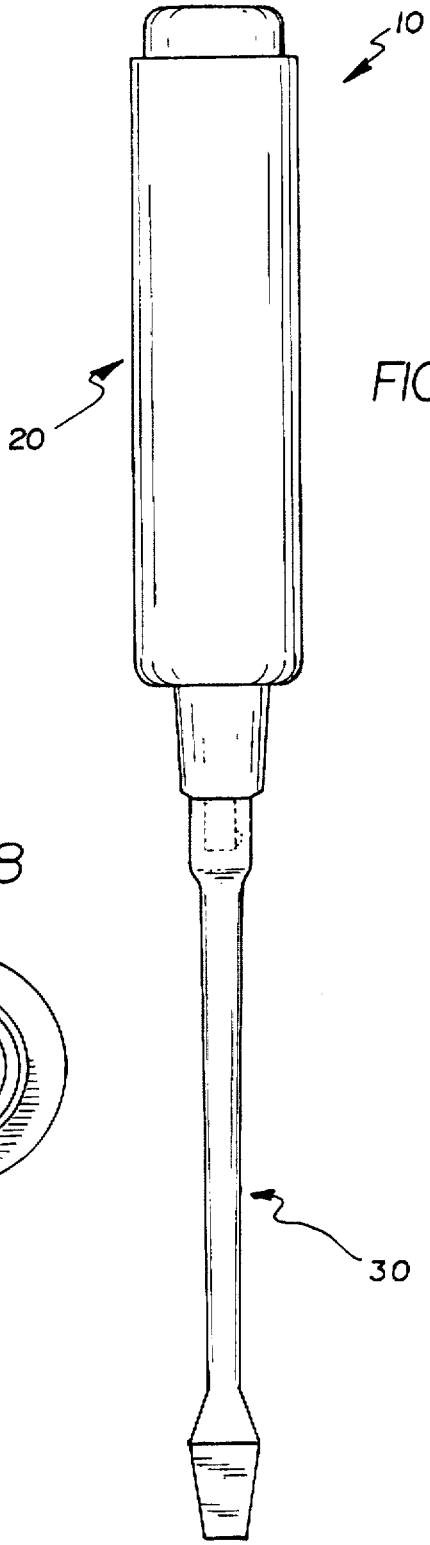
FIG. 9 is a cross sectional view of still another embodiment of the present invention showing electromagnetic coils wrapped internal around an inner shaft and in close proximity adjacent to a tool tip in a unitary screwdriver construction.

FIGS. 7 through 9 show an alternate embodiment of the present invention utilizing a unitary screwdriver construction. FIG. 7 show exterior placement of the electrical windings. FIG. 9 shows interior placement of the electrical windings. FIG. 8 is a bottom view of the removable cap.

Figure 10:
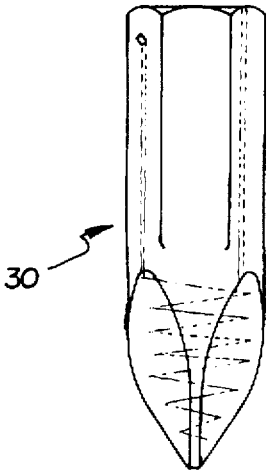
FIGS. 10 through 12 illustrate a variety of tool tips that can be used with the present invention.
Figure 11:
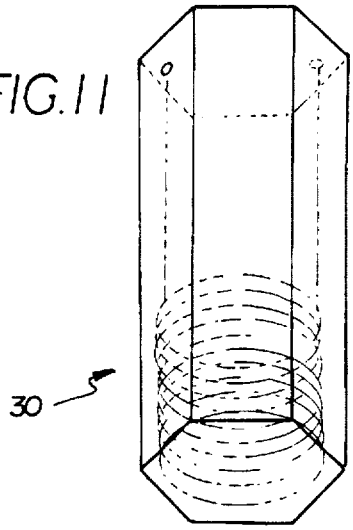
Figure 12:
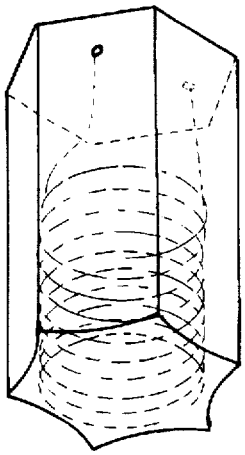
Figure 13:
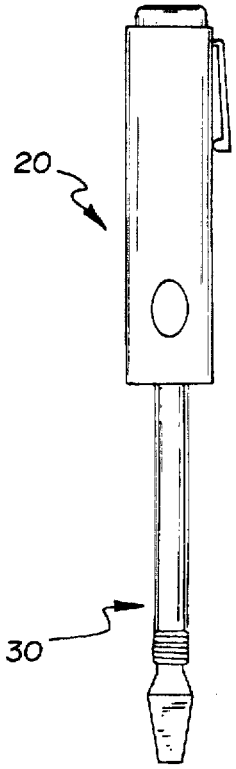
FIG. 13 is a side profile view of the embodiment of FIG. 7 of the present invention showing electromagnetic coils wrapped around an outer perimeter in close proximity adjacent to a tool tip in a unitary screwdriver construction.

FIGS. 10 through 12 demonstrate various types of tool heads which may be employed with the preferred embodiment of the present invention. FIG. 10 shows a phillips head type tool head, FIG. 11 shows a hexagonal tool head, and FIG. 12 shows a modified hexagonal tool head. These figures are considered demonstrative of various types of tool heads which may be employed and are not intended as an exhaustive list of the only types which may be used in conjunction with the present invention.

In use, the Electromagnetic Screwdriver 10 is equipped with a tool fitting of choice and allows momentary magnetic attraction while maneuvering to install or unassemble a screw or the like and prevents uncontrollable harmful effects of a magnetic contact with magnetic sensitive components. The magnetic coils can be included in the shaft of the screwdriver, ratchet, or other tool, extended to energize magnetic coils in a variety of extension S for the screwdriver, ratchet, or other tool, or included in a tool tip of the screwdriver, ratchet, or other tool.

As to a further discussion of the manner of usage and operation of the present invention, the same should be apparent front the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electromagnetic screwdriver, comprising:

an elongated cylindrical handle including a switch;

a drive shaft including electrical windings, the drive shaft joined together with the handle;

the handle further having a handle grip, a handle drive tube, a battery, a battery aperture, and a battery cap;

the handle grip defining an upper outer periphery of the handle;

the handle drive tube extending from an inner portion of the handle and protruding out of a lower end of the handle;

the handle drive tube having an upper end integrally forming the battery aperture where the battery aperture matingly receives the battery;

the battery being removably retained by the battery cap which is removably attached to the handle;

the battery aperture further including an aperture attachment means and the battery cap further including a cap attachment means wherein the aperture attachment means matingly receives the cap attachment means, the drive shaft including a torsion shaft, a tool end defined as the distal end of the torsion shaft, a stem, and a tool aperture;

the torsion shaft concentrically including the tool aperture, the tool aperture protruding upwardly into the torsion shaft;

the stem being defined as an outer cover of the torsion shaft;

the torsion shaft being wrapped with the electrical windings, the torsion shaft together with the electrical windings being matingly received within the stem;

the switch being movably attached to the handle, the switch further being electrically connected to electric circuit wires;

the handle further including a battery spring which is spring biasedly disposed between the battery and an upper end of the handle drive tube;

a tool head being shaped to enable the tool head to matingly fit into the tool aperture of the drive shaft, the tool head further being in torsional engagement with the drive shafts, the tool head further having a positive receptacle and a negative receptacle, the tool end further including a positive pin pole and a negative contact which are fixedly attached to the torsion shaft, the positive pin and negative contact being in electrical connection with the electrical windings which are wrapped around the torsion shaft when the tool head is insertedly in torsional engagement with the tool aperture and therefore the drive shaft, the positive receptacle and the negative receptacle being in matingly electrical connection with the positive pin pole and the negative contact.

2. The Electromagnetic Screwdriver of claim 1, wherein the tool head is one of the type chosen from the group of tool head types consisting of flat head, phillips head, hexagonal head, and modified hexagonal head.

3. The Electromagnetic Screwdriver of claim 1, wherein the tool head is further defined as a needle point tool.

4. The Electromagnetic Screwdriver of claim 3, wherein a flexible shaft extension is inserted into the tool aperture of the drive shaft, the needle point tool being inserted into a distal end of the flexible shaft such that the needle point tool is in torsional engagement with the flexible shaft extension which is in turn in torsional engagement with the drive shaft, the flexible shaft extension further having a positive flexible shaft receptacle and a negative flexible shaft receptacle in matingly electrical connection between the positive pin pole and the negative contact and therefore extend out to a distal receptacle tool end.

5. An electromagnetic screwdriver, comprising:

a handle having a hollow interior adapted to hold a number of batteries:

a shaft extending from the handle, the shaft having a tool head receiving distal end;

electrical wiring leading from the hollow interior to the tool head receiving end, the electrical wiring adapted to form an electrical connection with batteries held within the hollow interior, the electrical wiring further formed to include an electrical coil within the shaft proximate the distal end, the electrical wiring further having a positive and negative contact exposed within the tool head receiving end;

a tool head removably coupled to the tool head receiving end, the tool head having a positive and a negative receptacle positioned to align with the positive and negative contacts within the tool head receiving end; and a switch positioned on the handle, the switch in communication with the electrical wiring such that utilization of the switch completes the electrical circuit to allow current to pass from the batteries to the electrical wiring, electrical coil, and tool head.

* * * * *